US007985325B2

(12) United States Patent
Rash et al.

(10) Patent No.: US 7,985,325 B2
(45) **Date of Patent: *Jul. 26, 2011**

(54) CLOSED CONTACT ELECTROPLATING CUP ASSEMBLY

(75) Inventors: Robert Rash, Portland, OR (US); Shantinath Ghongadi, Wilsonville, OR (US); Kousik Ganesan, Hillsboro, OR (US); Zhian He, Beaverton, OR (US); Tariq Majid, Wilsonville, OR (US); Jeff Hawkins, Portland, OR (US); Seshasayee Varadarajan, Lake Oswego, OR (US); Bryan Buckalew, Tualatin, OR (US)

(73) Assignee: Novellus Systems, Inc., San Jose, CA (US)

( * ) Notice: Subject to any disclaimer, the term of this patent is extended or adjusted under 35 U.S.C. 154(b) by 875 days.

This patent is subject to a terminal disclaimer.

(21) Appl. No.: 11/929,638

(22) Filed: Oct. 30, 2007

(65) Prior Publication Data

US 2009/0107836 A1 Apr. 30, 2009

(51) Int. Cl.
*C25D 17/06* (2006.01)

(52) U.S. Cl. ..... 204/242; 204/297.01; 204/297.1; 204/297.14; 204/279

(58) Field of Classification Search ..... None
See application file for complete search history.

(56) References Cited

U.S. PATENT DOCUMENTS

| | | | | |
|---|---|---|---|---|
| 4,466,864 | A * | 8/1984 | Bacon et al. | 205/105 |
| 5,000,827 | A | 3/1991 | Schuster et al. | |
| 5,221,449 | A | 6/1993 | Colgan et al. | |
| 5,227,041 | A * | 7/1993 | Brogden et al. | 204/297.05 |
| 5,281,485 | A | 1/1994 | Colgan et al. | |
| 5,482,611 | A | 1/1996 | Helmer et al. | |
| 5,853,559 | A | 12/1998 | Tamaki et al. | |
| 5,985,762 | A | 11/1999 | Geffken et al. | |
| 6,074,544 | A | 6/2000 | Reid et al. | |
| 6,099,702 | A | 8/2000 | Reid et al. | |
| 6,110,346 | A | 8/2000 | Reid et al. | |
| 6,124,203 | A | 9/2000 | Joo et al. | |
| 6,126,798 | A | 10/2000 | Reid et al. | |
| 6,139,712 | A | 10/2000 | Patton et al. | |

(Continued)

FOREIGN PATENT DOCUMENTS

WO WO 99/41434 8/1999

OTHER PUBLICATIONS

Shin-Etsu Polymer Co., Ltd., "L-Type Connector," http://www.shinpoly.co.jp/business/connector/products_e/l.html?typezeb (1 page) downloaded Feb. 16, 2011.

(Continued)

*Primary Examiner* — Harry D Wilkins, III
(74) *Attorney, Agent, or Firm* — Knobbe, Martens, Olson & Bear, LLP

(57) ABSTRACT

Embodiments of a closed-contact electroplating cup are disclosed. One embodiment comprises a cup bottom comprising an opening, and a seal disposed on the cup bottom around the opening. The seal comprises a wafer-contacting peak located substantially at an inner edge of the seal. The embodiment also comprises an electrical contact structure disposed over a portion of the seal, wherein the electrical contact structure comprises an outer ring and a plurality of contacts extending inwardly from the outer ring, and wherein each contact has a generally flat wafer-contacting surface. The embodiment further comprises a wafer-centering mechanism configured to center a wafer in the cup.

24 Claims, 5 Drawing Sheets

U.S. PATENT DOCUMENTS

| | | | | |
|---|---|---|---|---|
| 6,156,167 | A | 12/2000 | Patton et al. | |
| 6,159,354 | A | 12/2000 | Contolini et al. | |
| 6,162,344 | A | 12/2000 | Reid et al. | |
| 6,176,985 | B1 | 1/2001 | Downes, Jr. et al. | |
| 6,179,973 | B1 | 1/2001 | Lai et al. | |
| 6,179,983 | B1 | 1/2001 | Reid et al. | |
| 6,193,854 | B1 | 2/2001 | Lai et al. | |
| 6,217,716 | B1 | 4/2001 | Lai | |
| 6,221,757 | B1 | 4/2001 | Schmidbauer et al. | |
| 6,251,238 | B1 | 6/2001 | Kaufman et al. | |
| 6,251,242 | B1 | 6/2001 | Fu et al. | |
| 6,261,433 | B1 | 7/2001 | Landau | |
| 6,267,860 | B1 | 7/2001 | Brodsky | |
| 6,270,646 | B1 | 8/2001 | Walton et al. | |
| 6,274,008 | B1 | 8/2001 | Gopalraja et al. | |
| 6,277,249 | B1 | 8/2001 | Gopalraja et al. | |
| 6,303,010 | B1 * | 10/2001 | Woodruff et al. | 204/297.01 |
| 6,413,388 | B1 | 7/2002 | Uzoh et al. | |
| 6,436,249 | B1 | 8/2002 | Patton et al. | |
| 6,517,689 | B1 | 2/2003 | Hongo et al. | |
| 6,540,899 | B2 | 4/2003 | Keigler | |
| 6,551,487 | B1 | 4/2003 | Reid et al. | |
| 6,589,401 | B1 | 7/2003 | Patton et al. | |
| 6,627,052 | B2 | 9/2003 | Fluegel et al. | |
| 6,755,946 | B1 | 6/2004 | Patton et al. | |
| 6,755,954 | B2 | 6/2004 | Mayer et al. | |
| 6,773,560 | B2 | 8/2004 | Pedersen et al. | |
| 6,800,187 | B1 | 10/2004 | Reid et al. | |
| 6,908,540 | B2 | 6/2005 | Kholodenko | |
| 7,033,465 | B1 | 4/2006 | Patton et al. | |
| 7,070,686 | B2 | 7/2006 | Contolini et al. | |
| 7,087,144 | B2 | 8/2006 | Herchen | |
| 2002/0084183 | A1 | 7/2002 | Hanson et al. | |
| 2002/0108851 | A1 * | 8/2002 | Woodruff et al. | 204/242 |
| 2002/0144900 | A1 * | 10/2002 | Keigler | 204/297.05 |
| 2003/0010641 | A1 * | 1/2003 | Kholodenko | 205/80 |
| 2003/0085118 | A1 * | 5/2003 | Tench et al. | 204/224 R |
| 2003/0085119 | A1 * | 5/2003 | Davis et al. | 204/286.1 |
| 2004/0084301 | A1 | 5/2004 | Dordi et al. | |
| 2004/0149573 | A1 * | 8/2004 | Herchen | 204/297.01 |
| 2009/0107835 | A1 | 4/2009 | Ghongadi et al. | |
| 2010/0155254 | A1 | 6/2010 | Prabhakar et al. | |

OTHER PUBLICATIONS

Shin-Etsu Polymer Co., Ltd., "SS-Type Connector," http://www.shinpoly.co.jp/business/connector/products_e/ss.html?typezeb (2 pages) downloaded Feb. 16, 2011.

Office Action for U.S. Appl. No. 09/927,741, dated May 15, 2003, in 14 pages.

Final Office Action for U.S. Appl. No. 09/927,741, dated Oct. 7, 2003, in 10 pages.

Office Action for U.S. Appl. No. 09/927,741, dated Feb. 26, 2004, in 11 pages.

Notice of Allowance for U.S. Appl. No. 09/927,741, dated Jun. 1, 2004, in 12 pages.

Office Action for U.S. Appl. No. 10/010,954, dated Oct. 8, 2003, in 19 pages.

Notice of Allowance for U.S. Appl. No. 10/010,954, dated Feb. 26, 2004, in 7 pages.

Notice of Allowance for U.S. Appl. No. 10/309,414, dated Oct. 27, 2005, in 14 pages.

Office Action for U.S. Appl. No. 11/932,595, dated Jul. 7, 2010, in 28 pages.

Final Office Action for U.S. Appl. No. 11/932,595, dated Nov. 17, 2010, in 11 pages.

Notice of Allowance for U.S. Appl. No. 11/932,595, dated Jan. 26, 2011, in 7 pages.

Shantinath Ghongadi, et al., "Rapidly Cleanable Electroplating Cup Assembly", filed Oct. 31, 2007, U.S. Appl. No. 11/932,595, 24 pgs.

Notice of Allowance for U.S. Appl. No. 11/932,595, dated Mar. 8, 2011, in 8 pages.

Supplemental Notice of Allowance for U.S. Appl. No. 11/932,595, dated Mar. 11, 2011, in 2 pages.

Notice of Allowance for U.S. Appl. No. 11/932,595, dated Mar. 18, 2011, in 6 pages.

U.S. Appl. No. 13/079,745, filed Apr. 4, 2011, entitled "Rapidly Cleanable Electroplating Cup Seal."

* cited by examiner

CLOSED CONTACT ELECTROPLATING CUP ASSEMBLY

BACKGROUND

Electroplating is commonly used in integrated circuit manufacturing processes to form electrically conductive structures. For example, in a copper damascene process, electroplating is used to form copper lines and vias within channels previously etched into a dielectric layer. In such a process, a seed layer of copper is first deposited into the channels and on the substrate surface via physical vapor deposition. Then, electroplating is used to deposit a thicker copper layer over the seed layer such that the channels are completely filled. Excess copper is then removed by chemical mechanical polishing, thereby forming the individual copper features.

Current electroplating systems may be classified as "open contact" and "closed contact." Open contact plating systems are systems in which the wafer contacts that deliver electric current to the seed layer during plating are exposed to the plating solution. Likewise, closed contact plating systems are those in which the contacts are not exposed to the plating solution.

When fabricating integrated circuits, it is generally desirable to utilize as much wafer surface as possible for the fabrication of devices to increase a quantity of devices per wafer. However, electroplating systems generally utilize electrical contacts and other structures that contact the wafer during deposition, and therefore limit an amount of surface area that can be plated. For example, in open contact plating systems, because the electrodes are exposed to the plating solution during a plating process, the electrodes are plated to the substrate surface during the process. Removal of the electrodes exposes unplated regions where the electrodes contacted the substrate. Further, removal of the contacts may cause damage to the copper layer in the vicinity of the electrodes, rendering, for example, 2 mm or more of the outer perimeter of the wafer unsuitable for integrated circuit fabrication.

SUMMARY

Accordingly, embodiments of a closed-contact electroplating cup assembly are disclosed that may enable the use of a greater amount of a wafer surface for device fabrication than prior electroplating systems. For example, in one disclosed embodiment, a closed-contact electroplating cup assembly comprises a cup bottom comprising an opening, and a seal disposed on the cup bottom around the opening. The seal comprises a wafer-contacting peak located substantially at an inner edge of the seal. The disclosed electroplating cup assembly embodiment also comprises an electrical contact structure disposed over a portion of the seal. The electrical contact structure comprises an outer ring and a plurality of contacts extending inwardly from the outer ring, wherein each contact has a generally flat wafer-contacting surface. Further, the disclosed electroplating cup assembly embodiment comprises a wafer-centering mechanism configured to center a wafer in the cup assembly.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
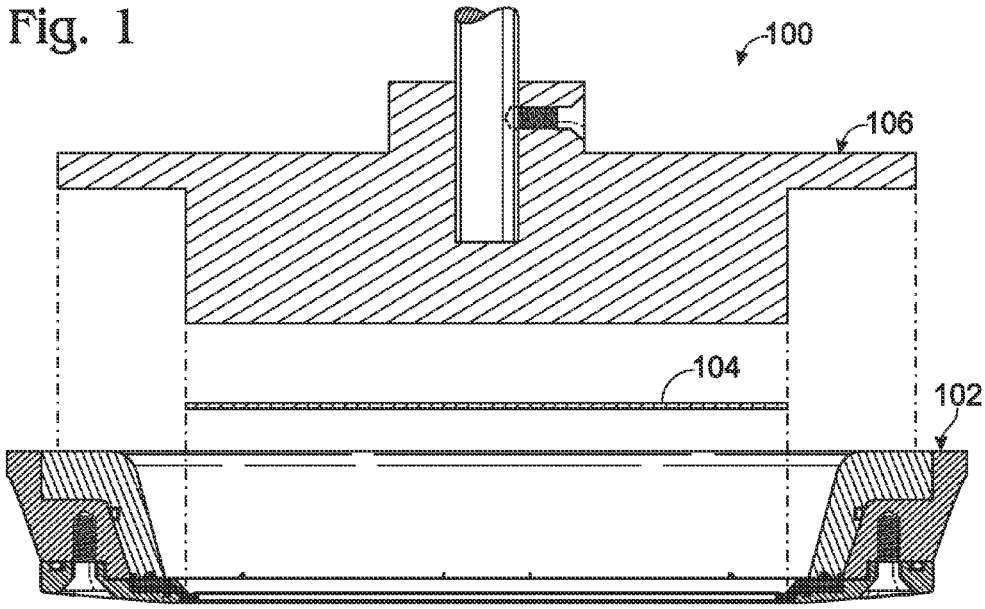
FIG. 1 shows an embodiment of an electroplating substrate holder comprising a cone assembly and a cup assembly.

FIG. 1 shows an embodiment of a closed contact substrate holder 100 for holding a wafer during an electroplating process. The substrate holder 100 may also be referred to herein as "clamshell 100." The clamshell 100 comprises a cup assembly 102 in which a wafer 104 is positioned during an electroplating process, and also a cone assembly 106 that is lowered into the cup assembly to clamp the wafer in a desired position within the cup assembly 102 for an electroplating process.

As described in more detail, the disclosed cup assembly 102 comprises various features that allow for the capability to plate copper (or any other suitable metal) to within 1 mm of the edge of the wafer (or potentially closer), even in light of possible variability of bevel location between wafers. Further, the disclosed cup assembly embodiments provide a uniform electric field around the wafer (i.e. in an "azimuthal" direction), and therefore enables a highly uniform film growth thickness to within 2 mm of the edge of the wafer. Additionally, the disclosed embodiments also enable defect control up to 3 mm from the wafer edge. These features and others are described in more detail below.

Figure 2:
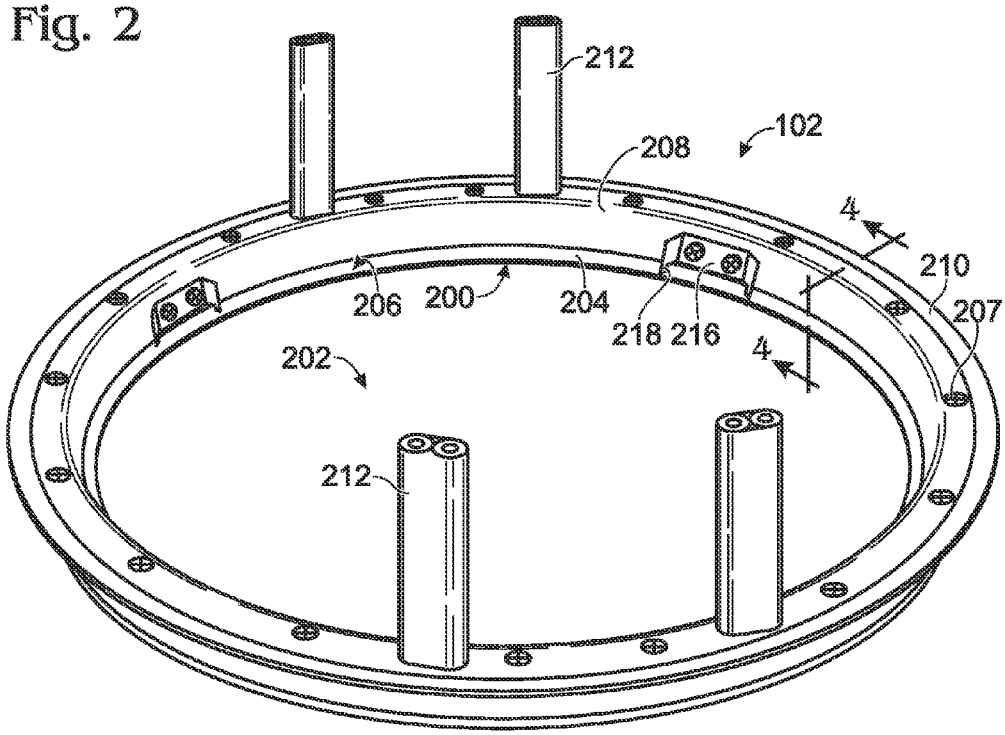
FIG. 2 shows a perspective view of the embodiment of the electroplating cup assembly of FIG. 1.
Figure 3:
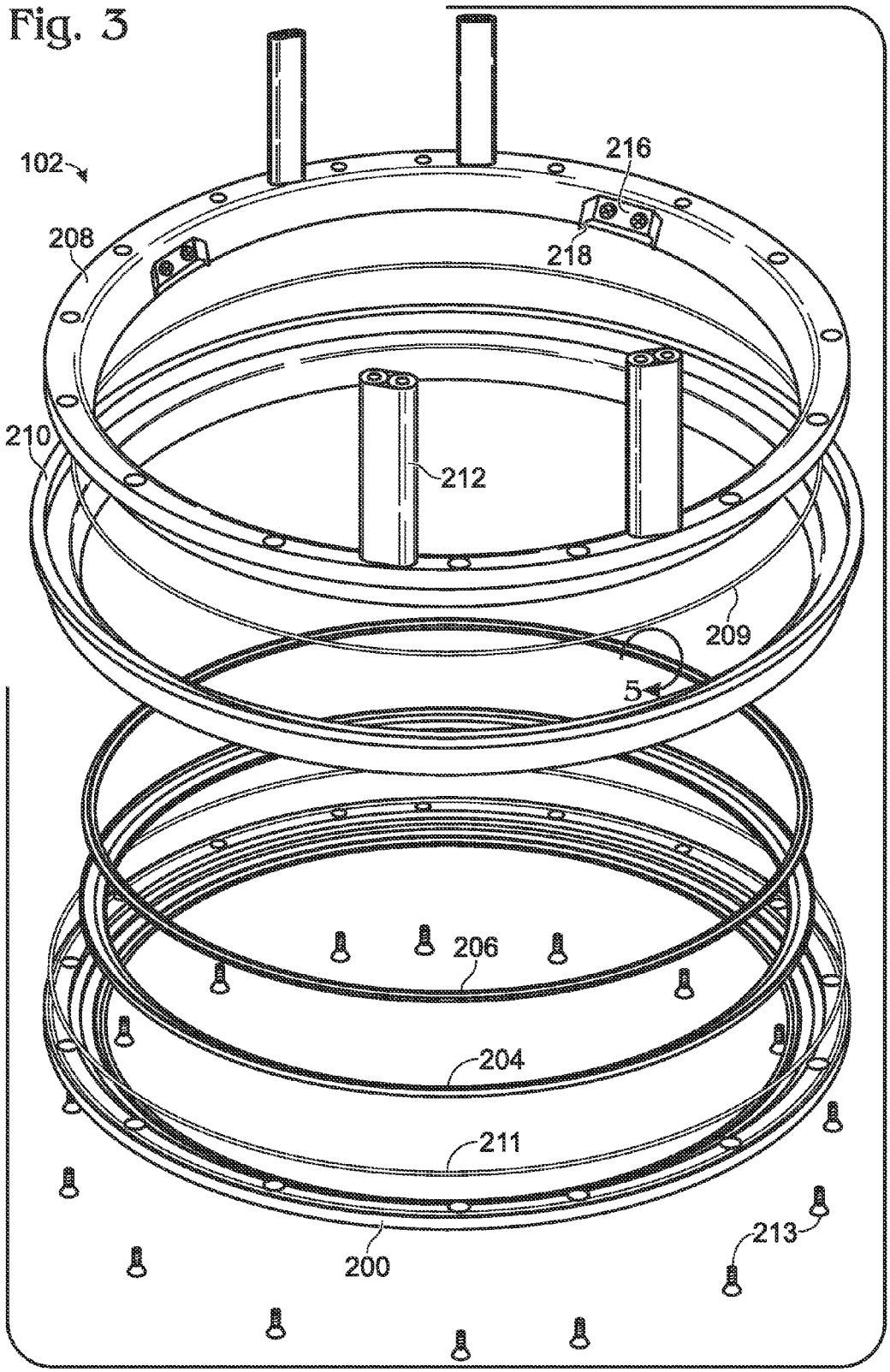
FIG. 3 shows an exploded view of the embodiment of FIG. 2.
Figure 4:
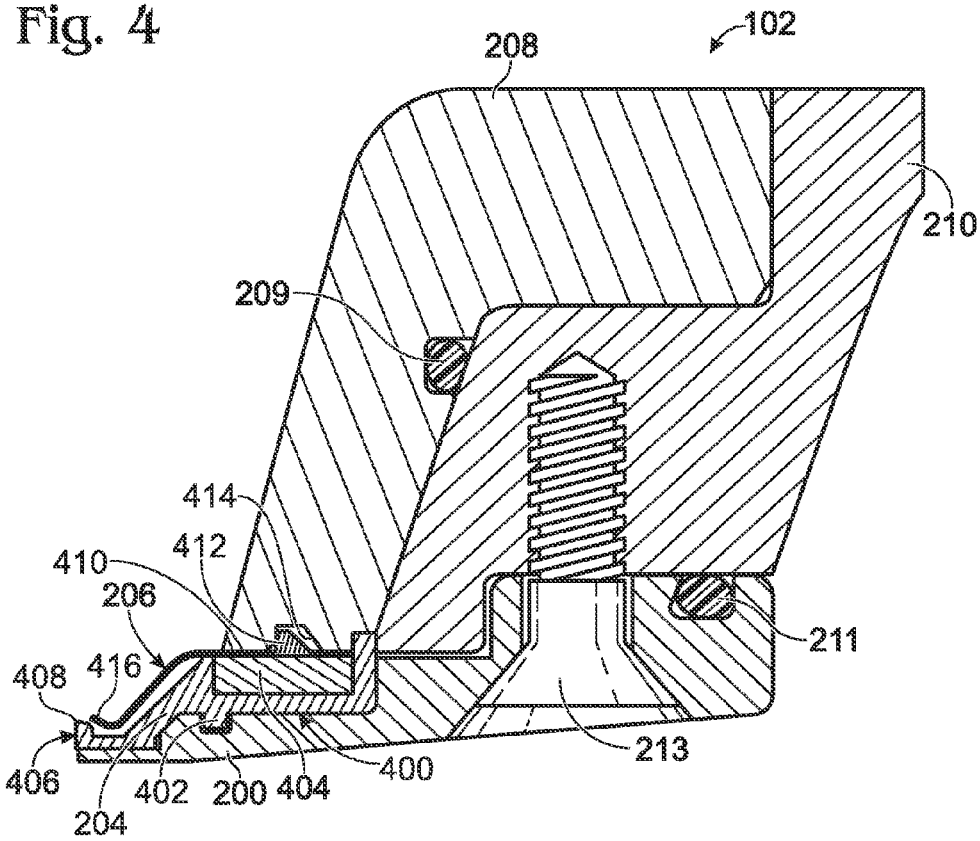
FIG. 4 shows a sectional view of the embodiment of FIG. 2.

FIGS. 2-4 show the cup assembly 102 in more detail. Referring first to FIGS. 2-3, the cup assembly 102 comprises several major components. For example, cup assembly 102 comprises a cup bottom 200 that defines an opening 202 to allow exposure of a wafer positioned in the cup assembly 102 to an electroplating solution. Further, a seal 204 disposed on the cup bottom 200 is configured to form a seal against a wafer positioned in the cup assembly 102 to prevent plating solution from reaching the contacts located behind the seal. The opening 202 and the seal 204 have an inner diameter configured to expose a desired amount of surface area of a wafer to a plating solution. For example, where it is desired to plate a film onto a 300 mm wafer with a 1 mm exclusion zone (i.e. unplated area) adjacent to the wafer edge, the opening 202 and the seal 204 may have an inner diameter of 298 mm, thereby covering only 1 mm on each side of the wafer. Likewise, where it is desired to plate a film onto a 300 mm wafer with a 1.75 mm exclusion zone, an inner diameter of 296.5 mm may be used. More generally, for any wafer size, the opening 202 and the seal 204 may have an inner diameter equal to the wafer diameter minus approximately 2× the desired exclusion zone width.

Figure 10:
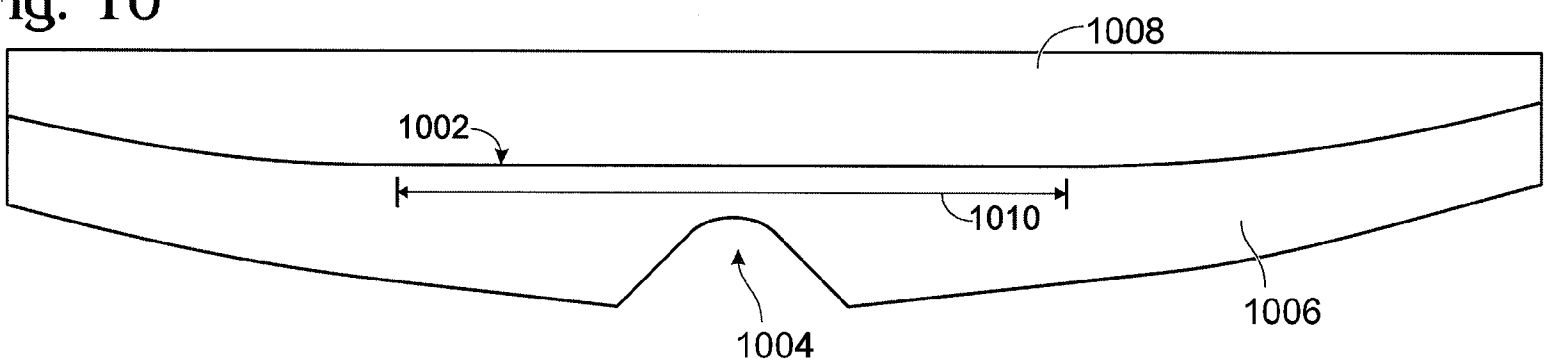
FIG. 10 shows a schematic depiction of an embodiment of an electroplating cup seal with a flattened inner perimeter portion to accommodate a wafer notch.

In some embodiments, the seal 204 may comprise a section of its inner perimeter configured to accommodate a wafer notch. Various different features may be used to accommodate the wafer notch. For example, the generally circular inner perimeter of the seal 204 may comprise a flattened section having a reduced inner diameter in the portion of the seal configured to seal the notch region, as shown in FIG. 10. In this figure, the flat region of the seal inner perimeter is illustrated schematically at 1002 and a wafer notch is shown at 1004. Further, the exclusion zone of the wafer is shown at 1006 (indicating the portion of the wafer protected from the plating solution by the seal), and the plating surface of the wafer is shown at 1008. It will be appreciated that the cross-sectional profile of the seal in the flattened inner perimeter region (i.e. with the peak of the seal located at the inner edge of the seal) is the same as in the non-flattened inner perimeter region.

The flattened section 1002 may have any suitable length (indicated by line 1010). For example, for a 300 mm wafer and a seal with an exclusion zone of 1 mm, one embodiment of a flattened inner perimeter section may have a length of approximately 1.097 inches end-to-end to accommodate the notch. Such a seal may be approximately 1.75 mm from the edge of the wafer at the edge of the notch. Alternatively, the inner perimeter of the seal 204 may include a notch-shaped inward depression in the inner perimeter of the seal that outlines the shape of the notch at any suitable distance from the notch. It will be understood that any suitable structure other than these may be used to cover the notch region of a wafer without departing from the scope of the present invention.

The cup bottom 200 may be made from any suitable material. Suitable materials include materials capable of demonstrating high strength and stiffness at thicknesses used for the cup bottom, and also that resist corrosion by low pH plating solutions, such as copper/sulfuric acid solutions. One specific example of a suitable material is titanium.

Likewise, the seal 204 also may be formed from any suitable material. Suitable materials include materials that do not react with or are not corroded by a desired plating solution, and are of a sufficiently high purity not to introduce contaminants into the plating solution. Examples of suitable materials include, but are not limited to, perfluoro polymers sold under the name Chemraz, available from Greene, Tweed of Kulpsville, Pa. Further, in some embodiments, the seal 204 may be coated with a hydrophobic coating so that the seal 204 sheds aqueous plating solution when removed from a plating bath. This may help to prevent the introduction of plating solution to the electrode area behind the seal 204 when a wafer is removed from the cup assembly 102 after plating. Likewise, the seal may be adhered to the cup bottom in some embodiments. This may help to preserve the circular shape of the seal when the seal is compressed against a wafer surface, and thereby may help to maintain a uniform exclusion zone of a desired size.

The seal 204 and cup bottom 200 may have any suitable thickness. In some embodiments, the seal 204 and cup bottom 200 are configured to be sufficiently thin along an axial dimension of the cup, in a direction normal to the surface of a wafer in the cup, to reduce the formation of defects that are related to cup bottom thickness. It has been found that the thickness of the cup and seal along this dimension may directly affect the formation of detrimental defects in an electrodeposited film. It has been found that such defects may be limited to within approximately 3 mm of the wafer edge by using a cup bottom with a thickness on the order of, for example, 0.015 inch+/−0.002 inch.

Likewise, the seal 204 also may be configured to have a low profile in this dimension. This may help to reduce film defects, to prevent bowing of the seal 204 when compressed, and to improve the shear strength of the seal 204, thereby increasing seal lifetime. Suitable thicknesses for the inner perimeter of the seal include, but are not limited to, thicknesses in the range of 0.035 inch+/−0.003 inch. In one specific embodiment, the cup bottom has a thickness of 0.015 inch, and the seal has a thickness at its inner perimeter of 0.035 inch. It will be appreciated that the above-disclosed ranges for the thickness of the cup bottom 200 and the seal 204 are disclosed for the purpose of example, and are not intended to be limiting in any manner. Other structures of the seal 204 that help to enable the achievement of a narrow exclusion zone are described in more detail below.

Continuing with FIGS. 2 and 3, the cup assembly 102 further comprises a contact structure 206 configured to form an electrical connection between an external power supply and a wafer positioned in the cup assembly 102. The seal 204 is positioned between the contact structure 206 and the cup bottom 200, and thereby insulates the cup bottom 200 from the contact structure 206. Details of the contact structure are described below.

The contact structure 206 is connected to a conductive ring 208 that rests on and is in electrical contact with an outer portion of the electrical contact structure. The conductive ring 208 may also be referred to herein as a "bus bar 208". The depicted bus bar 208 is configured as a continuous, thick ring of metal. The continuous construction may help to enable uniform electric field distribution to the contact structure 206, and thereby may help to improve azimuthal deposition uniformity. Further, this construction also may provide mechanical strength to the system relative to a multi-part bus bar. This may help to avoid cup deflection when the cone is closed against the cup. While the depicted bus bar has a continuous construction, it will be appreciated that a bus bar may also have a segmented or other non-continuous construction without departing from the scope of the present invention.

The bus bar 208 is positioned within and substantially surrounded by a shield structure 210 that electrically insulates the bus bar 208 from the cup bottom 200 and from the plating solution. An o-ring 209 may be located between the bus bar 208 and shield structure 210 to seal the space between these structures, and one or more bolts 207 or other fasteners may be used to secure these structures together. Likewise, an o-ring 211 may be located between the shield structure 210 and the cup bottom 200 to prevent plating solution from reaching the spaces between these structures. One or more bolts 213 may also be used to hold these structures together.

An electrical connection is made to the bus bar 208 through a plurality of struts 212 that extend from a top surface of the bus bar 208. The struts 212 are made from an electrically conductive material, and act as a conductor through which electrical current reaches the bus bar 208. In some embodiments, the struts 212 may be coated with an insulating coating. The struts 212 also structurally connect the cup assembly 102 to a drive mechanism (not shown) that allows the cup to be lifted from and lowered into a plating solution, and also that allows the cup and cone to be rotated during a plating process. The location of struts 212 internal to the bus bar 208, rather than on an outside portion of the cup, helps to prevent the formation of a wake caused by the struts 212 pulling through the plating solution during rotation of the clamshell 100 in a plating process. This may help to avoid introduction of plating solution into the space between the cup assembly 102 and cone assembly 106 during a plating process, and therefore may help to reduce a frequency at which to perform preventative maintenance. While the depicted embodiment comprises four struts, it will be appreciated that any suitable number of struts, either more or less than four, may be used.

Continuing with FIGS. 2-3, a wafer centering mechanism is provided to hold a wafer in a correct location within the cup assembly 102. The depicted wafer centering mechanism comprises a plurality of leaf springs 216 positioned around an inside of the bus bar 208. Each leaf spring 216 comprises a pair of downwardly-extending ends 218 that contact an edge of a wafer positioned in the cup. The spring forces exerted by each leaf spring 216 balance to hold the wafer in a correct position relative to the seal 204, the contact structure 206, etc.

FIG. 4 shows a sectional view of cup assembly 102, and illustrates various detailed features of the cup that enable the achievement of a 1 mm or smaller exclusion zone. First, the seal 204 comprises a ring-shaped mounting structure 400 with a bottom surface that is shaped to match a contour of the cup bottom 200. The mounting structure 400 comprises a keying feature 402 configured to fit within a complimentary groove of the cup bottom 200. The keying feature 402 helps to hold the seal 204 in a correct position relative to the cup bottom opening 202 during installation and replacement of the seal. This may help to prevent any portion of the seal from sliding, deforming, or otherwise moving from the desired spacing from the wafer edge (1 mm or otherwise) when the wafer is clamped into the cup assembly 102.

The mounting structure 400 of the seal 204 also comprises a feature, such as a groove formed in its upper surface, that is configured to accommodate a stiffening ring 404. The stiffening ring is seated within the groove to provide support to the seal and help achieve tighter manufacturing tolerances. In some embodiments, the seal 204 may be bonded to the stiffening ring for additional robustness.

Continuing with FIG. 4, the seal 204 further comprises a sealing structure 406 that extends upwardly (with reference to the orientation of FIG. 4) from the mounting structure 402 at an inner perimeter of the sealing structure. The sealing structure 406 comprises a peak 408 located substantially at an inner edge of an upwardly extending inner portion of the sealing structure 406. The term "substantially at an inner edge" as used herein includes configurations in which the peak 408 is located within a range of manufacturing tolerances relative to the inner edge of the sealing structure 406. This is in contrast to other electroplating systems, in which the peak of the seal is located between the inner and outer edge of the sealing structure.

Locating the peak 408 of the sealing structure 406 at the inner edge of the sealing structure 406 offers improved access of the plating solution to the wafer surface right to the edge of the seal. Where the peak of the sealing surface is located spaced from the inner edge of the seal structure (for example, with a seal having a rounded top profile), compression of a wafer against the seal may cause a region immediately adjacent to where the seal separates from the wafer surface to have reduced access to plating solution. This may result in unacceptable variations in film thickness in the vicinity of the seal. In contrast, where the peak 408 of the sealing surface is located at the inner edge of the sealing structure 406, the more vertical orientation of the sealing structure in the vicinity of the peak 408 may allow for better plating solution access, and therefore better film thickness uniformity. Further, as described above, the seal may be configured to have a relatively thin profile (top to bottom) at the peak 408 to increase the lifetime of the seal and also to prevent the occurrence of defects, such as C-line defects, in the growing film that may be linked to the edge height of the seal 204 and cup bottom 200. Examples of suitable thicknesses are given above. Further, the upwardly extending portion of the seal on which the peak is located also may be configured to have a relatively thin profile from inside to outside. One non-limiting example of a suitable seal thickness in this dimension is 0.018+/−0.002 inches.

Figure 5:
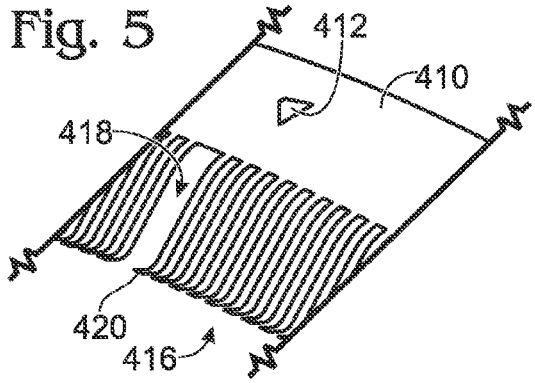
FIG. 5 shows a magnified view of an embodiment of an electrical contact structure for an electroplating cup assembly.

Referring next to FIGS. 4 and 5, the contact structure 206 also comprises various structures configured to enable the achievement of exclusion zones of 1 mm or less. First, the contact structure 206 comprises a continuous outer ring 410 that is positioned beneath and in contact with the bus bar 208 to allow uniform distribution of current from the bus bar 208 to the contact structure 206. Further, the contact structure comprises a plurality tabs 412 that extend upwardly from the outer ring 410 of the contact structure into a groove 414 formed in the bus bar 408. As shown in FIG. 4, the tab 412 contacts an inner edge of the groove 414. The tabs are configured to center the contact structure 206 in a correct location relative to the seal 204 and cup bottom 200 to ensure that all of the individual contacts (described below) on the contact structure 206 touch the plating seed layer on a wafer positioned in the cup. Further, this feature also helps prevent any contacts from slipping past the seal 204 when a wafer is clamped into the cup assembly 102 by the cone 106. The bus bar 208 may comprise a single groove 414 that extends partially or fully around the bus bar 208, or may comprise two or more individual grooves that each accommodates one or more tabs 412.

The contact structure 206 comprises a plurality of contacts 416 that extend from the outer ring 410 toward a center of the contact structure 206. Each contact 416 comprises a downward extending portion 418 that is spaced from the seal 204, and an upwardly turned end portion 420 configured to contact a wafer positioned in the cup assembly 102. In this manner, each contact 416 acts as a leaf spring that is pushed against the surface of a wafer in the cup with some spring force to ensure good contact between the contacts 416 and the wafer. This allows the contacts 416 to make good electrical contact with a wafer on either the bevel or the wafer surface. Therefore, this feature accommodates normal variations in the bevel position.

The contact structure 206 may include any suitable number of and/or density of contacts 416, depending upon the wafer size to be used with the cup assembly 102. For example, where the cup assembly 102 is configured for use with 300 mm wafers, the contacts may have a cross-sectional width in the range of, for example, 0.040 inch+/−0.001 inch, and may be separated by a spacing in the range of 0.021 inch+/−0.001 inch. It will be appreciated that these ranges are set forth for the purpose of example, and that contact widths and spacings outside of these ranges may also be suitable. Further, gaps 418 may be provided between selected pairs of contacts 216 to accommodate leaf spring ends 218. Better azimuthal uniformity may be achieved with a greater density of contacts. For example, one specific embodiment comprising 592 contacts with a cross-sectional width of 1 mm and a separation of 0.5 mm from adjacent contacts was found to give good azimuthal uniformity. It will be understood that these numbers and ranges for the contact dimensions are given for the purpose of example, and are not intended to be limiting in any manner.

To protect the contacts 416 from being plated by the plating solution, the contacts 416 are configured to extend to a point just short of the peak 408 of the seal 204. The distance by which the ends of the contacts 416 are separated from the peak 408 of the seal may be selected based upon the desired exclusion zone in light of the potential variability in bevel position. For example, where a 1 mm exclusion zone is desired, the peak 408 of the seal 204 is positioned 1 mm from the wafer edge. The bevel generally starts 0.5 mm from the wafer edge, but may vary from this position by approximately +/−0.25 mm. In light of this, each contact 416 may be configured to contact the wafer, for example, at a location between 0.2 and 0.7 mm from the wafer edge. In one specific embodiment where the peak of the seal is positioned at the inner edge of the seal, each contact 416 may be spaced 0.022+/−0.002 inch from the peak of the seal.

Continuing with FIG. 5, each contact 416 may comprise a wafer-contacting surface 420 located at or proximate an inner edge of the contact 416. As can be seen in FIG. 5, the wafer-contacting surface 420 has a generally flat cross-sectional shape, allowing the wafer-contacting surface to distribute the pressure exerted by the contact on the wafer across a broader surface area relative to the use of sharp contacts. This is in contrast to other electroplating systems, which may employ point-shaped contacts configured to touch only a minimal portion of the wafer surface. Such contacts may damage the low dielectric constant materials used for the dielectric layer underlying the plated metal layer, which may cause defects in the growing film and also harm devices fabricated on the wafer. The use of the flat wafer-contacting surface may reduce the incidence of such damage, and therefore may improve device yields.

Figure 6:
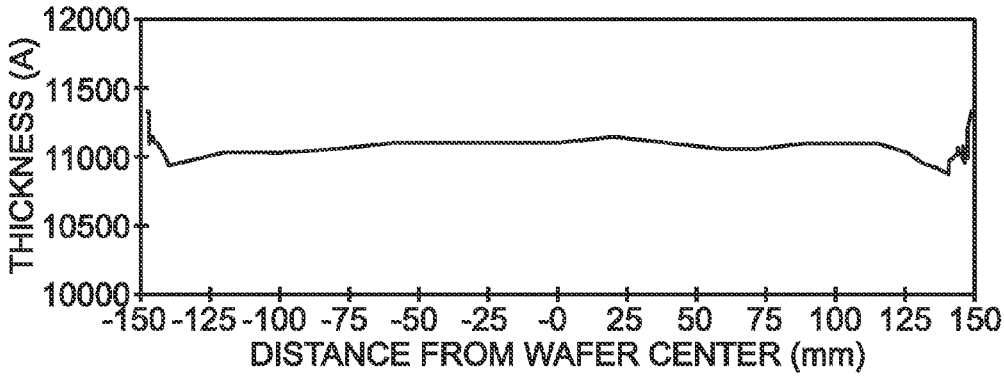
FIG. 6 shows a graph of a thickness of a copper film deposited via the electroplating cup assembly embodiment of FIG. 2 as a function of distance from the wafer center.
Figure 7:
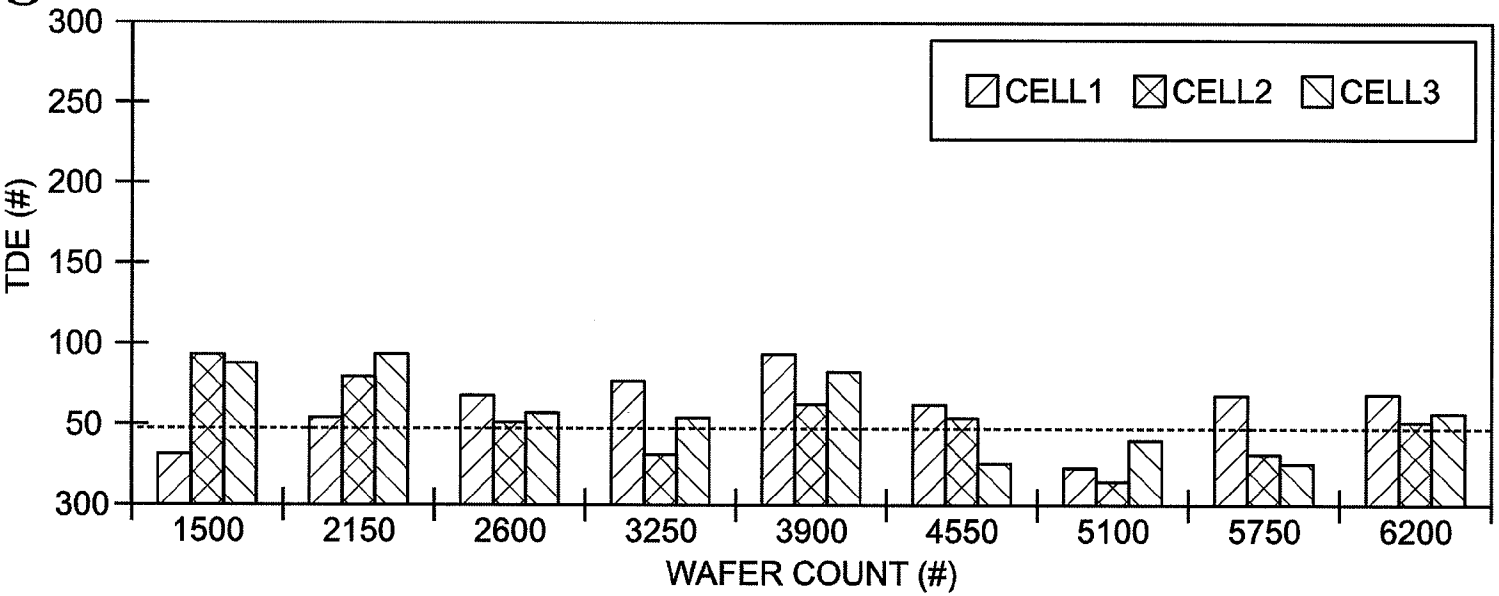
FIG. 7 shows a graph of an in-film defect count for wafers processed with the electroplating cup assembly embodiment of FIG. 2 over a period of 7000 wafer cycles.

Experimental results have shown that an electroplating cup according to the present disclosure can achieve a 1 mm exclusion zone with low defect counts and good edge-to-edge film uniformity. First, FIG. 6 shows a graph of the thickness of a 1 micron copper film plated on a 300 mm silicon wafer with a plating cup having 592 contacts each with a width of 1 mm and a spacing 1 mm from adjacent contacts. As can be seen, the thickness variation across the film is maintained at less than 2% up to 2 mm from the edge of the wafer. Next, FIG. 7 shows the in-film defect count collected over 7000 wafer cycles without any preventative maintenance. Defect count was measured up to 3 mm of the edge of the wafer. As can be seen in this figure, the performance is consistently maintained to less than 100 counts.

Figure 8:
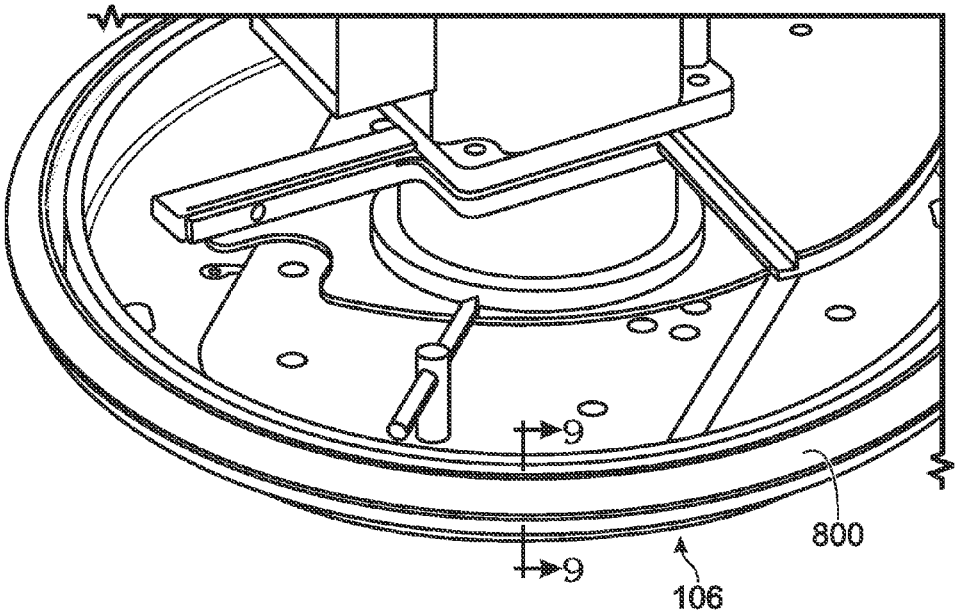
FIG. 8 shows a view of an embodiment of an electroplating cone assembly.
Figure 9:
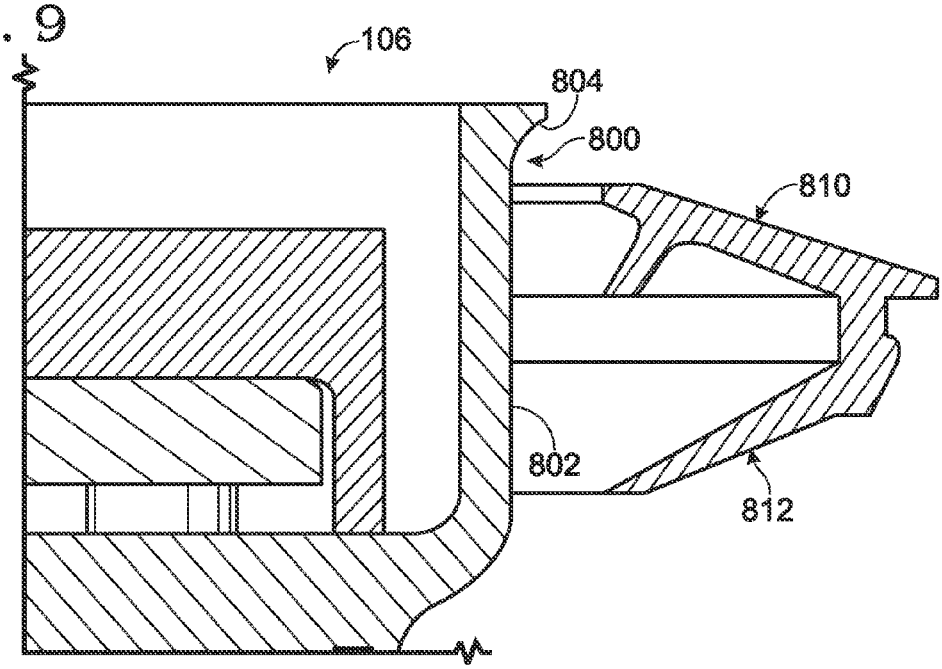
FIG. 9 shows a magnified view of a splash shield of the embodiment of FIG. 8.

Continuing with the Figures, FIGS. 8 and 9 show a perspective view of an embodiment of plating cone assembly 106 comprising an integrated splash shield 800, and also shows a rinse ring of a plating cell 810. The combination of the splash shield 800 and rinse ring 810 helps to enable high speed axial entry of the clamshell 100, on the order of 200 mm/s, into a plating cell. At such entry speeds, without a splash shield, the splash from the entry may splash over the cone and gravitate down the struts 212 into the cup assembly 102. The rinse ring 810 is configured to deflect such splash away from the cone assembly 106, and the splash shield 800 helps to ensure that no splashed plating solution reaches the upper portion of the cup, therefore helping to avoid this mode of contamination.

As shown in FIG. 9, the splash shield 800 comprises a vertically oriented protective wall 802 and an outwardly flared lip 804 that cooperate to deflect splashed plating solution away from the cone assembly 106. The rinse ring 810 likewise comprises a lower surface configured 812 to deflect splash outwardly and downwardly away from the cone assembly 106. Further, the splash shield comprises an outer diameter configured to match the inner diameter of the rinse ring, thereby offering further protection against plating solution splashing outside of the cell.

It will be understood that the configurations and/or approaches described herein are exemplary in nature, and that these specific embodiments or examples are not to be considered in a limiting sense, because numerous variations are possible. The subject matter of the present disclosure includes all novel and nonobvious combinations and subcombinations of the various processes, systems and configurations, and other features, functions, acts, and/or properties disclosed herein, as well as any and all equivalents thereof.

The invention claimed is:

1. A closed-contact electroplating cup, comprising:

a cup bottom comprising an opening;

a seal disposed on the cup bottom around the opening, the seal comprising a wafer contacting peak located substantially at an inner edge of the seal, wherein the seal is bonded to a stiffening ring that is seated in the seal;

an electrical contact structure disposed over a portion of the seal, the electrical contact structure comprising an outer ring and a plurality of contacts extending inwardly therefrom, each contact having a generally flat wafer-contacting surface; and a wafer centering mechanism configured to center a wafer in the cup.

2. The electroplating cup of claim 1, wherein the seal has a generally ring-shaped configuration with an inner diameter in a range of 296.5-298 mm.

3. The electroplating cup of claim 1, wherein the wafer-contacting surface of each contact has a cross-sectional width of 0.040 inch+/−0.001 inch.

4. The electroplating cup of claim 1, wherein the wafer-contacting surface of each contact is separated from an adjacent contact by a width of approximately 0.021 inch+/−0.001 inch.

5. The electroplating cup of claim 1, wherein the wafer-centering mechanism comprises a plurality of leaf springs arranged around an interior side of the electroplating cup.

6. The electroplating cup of claim 1, further comprising an electrically conducting bus bar disposed over and in contact with the outer ring of the electrical contact structure.

7. The electroplating cup of claim 6, wherein the outer ring of the electrical contact structure comprises a plurality of tabs configured to extend into one or more grooves in the bus bar.

8. The electroplating cup of claim 1, wherein the seal has a thickness at the peak 0.035+/−0.003 inch.

9. The electroplating cup of claim 1, wherein the wafer-contacting surface of each contact is positioned 0.5 mm or less from the peak of the seal.

10. A closed-contact electroplating cup, comprising:

a cup bottom comprising an opening;

a seal disposed on the cup bottom around the opening and comprising a peak with an inner diameter equal to or less than 2 mm smaller than an outer diameter of a wafer for which the cup is utilized;

a stiffening bar bonded to the seal;

an electrical contact structure comprising an electrically conductive outer ring and a plurality of contacts extending inwardly from the outer ring, each contact comprising a generally flat wafer-contacting surface;

an electrically conductive bus bar in contact with the outer ring of the electrical contact structure and comprising a groove;

a positioning tab extending from the outer ring of the electrical contact structure into the groove in the bus bar; and a wafer centering mechanism configured to center a wafer in the cup.

11. The electroplating cup of claim 10, wherein the wafer-contacting surface of each contact is positioned 0.022 inch+/−0.002 inch from the peak of the seal.

12. The electroplating cup of claim 10, further comprising a plurality of positioning tabs each extending from the outer ring of the electrical contact structure into a groove in the bus bar.

13. The electroplating cup of claim 10, further comprising one or more struts extending upwardly from an upper portion of the bus bar.

14. A seal configured to seal an opening in a closed-contact electroplating cup when a wafer is positioned over the opening and in contact with the seal, the seal comprising:

a ring-shaped mounting structure comprising a mounting surface configured to rest on a complementary surface on the electroplating cup;

a groove formed in an upper surface of the mounting structure and configured to accommodate a stiffening ring;

a keying feature extending downwardly from the mounting surface; and a sealing structure extending upwardly from an end of the mounting structure, wherein the sealing structure comprises a peak located substantially at an inner edge of the sealing structure.

15. The seal of claim 14, wherein the seal further comprises a generally circular inner circumference with a feature configured to seal a notch region of a wafer.

16. The seal of claim 15, wherein the feature comprises a flattened section having a reduced inner diameter.

17. The seal of claim 15, wherein the feature has a length of about 1.097 inches.

18. The seal of claim 15, wherein the feature comprises a notch-shaped inward depression.

19. The seal of claim 14, further comprising a hydrophobic coating.

20. The seal of claim 14, wherein an inner side of the sealing structure has a thickness of in the range of 0.032 inches to 0.038 inches along an axial dimension of the sealing structure.

21. The seal of claim 14, further comprising a stiffening ring disposed in the groove.

22. The seal of claim 21, wherein the stiffening ring is bonded to the groove.

23. The seal of claim 14, wherein the peak has a thickness from inside to outside in the range of 0.016 inches to 0.02 inches.

24. The seal of claim 14, wherein the seal comprises a perfluoro polymer.

* * * * *

UNITED STATES PATENT AND TRADEMARK OFFICE

CERTIFICATE OF CORRECTION

PATENT NO. : 7,985,325 B2
APPLICATION NO. : 11/929638
DATED : July 26, 2011
INVENTOR(S) : Robert Rash et al.

It is certified that error appears in the above-identified patent and that said Letters Patent is hereby corrected as shown below:

At Column 10, Line 13, in Claim 20, after "thickness" delete "of".

Signed and Sealed this
First Day of May, 2012

David J. Kappos

David J. Kappos
*Director of the United States Patent and Trademark Office*